[11]
[45] Oct. 4, 1977

United States Patent [19]

Hasegawa et al.

[54] STACKER DRUM OF SHEET ACCUMULATING DEVICE

[75] Inventors: Kaiichi Hasegawa, Kawasaki; Fumio Sanuga, Inagi, both of Japan

[73] Assignee: Fuji Giken Kabushiki Kaisha, Tokyo, Japan

[21] Appl. No.: 759,975

[22] Filed: Jan. 17, 1977

[30] Foreign Application Priority Data

Jan. 28, 1976 Japan ..... 51-7594[U]

[51] Int. Cl.[2] ..... B65H 29/40

[52] U.S. Cl. ..... 271/187; 198/695; 214/7; 271/80

[58] Field of Search ..... 271/80, 187, 178, 82, 271/83, 277; 214/7; 198/695, 653

[56] References Cited

U.S. PATENT DOCUMENTS 2,031,136 2/1936 Sewick ..... 271/80

3,162,438 12/1964 Perry ..... 271/187

FOREIGN PATENT DOCUMENTS 622,611 12/1935 Germany ..... 271/178

*Primary Examiner*—Bruce H. Stoner, Jr.
*Attorney, Agent, or Firm*—Ladas, Parry, Von Gehr, Goldsmith & Deschamps

[57] ABSTRACT

In a stacker drum of a sheet accumulating device for stacking paper money and the like, which stacker drum has around its cylindrical surface several blades secured at their inner root parts to the drum and extending tangentially in the direction opposite to the drum rota tional direction to their outer ends, a curved leaf sprin is secured to each blade in a manner to narrow the spac between each pair of adjacent blades thereby to preve disturbance of the steady flow of sheets such as pap money fed to and entering respective spaces betwe the blades to be accumulated into a neat stack.

2 Claims, 4 Drawing Figures

STACKER DRUM OF SHEET ACCUMULATING DEVICE

BACKGROUND OF THE INVENTION

This invention relates generally to apparatuses for handling and processing large numbers of pieces of sheet material such as paper money and more particularly to sheet accumulating devices of the type which renders such pieces of sheet material (hereinafter referred to as "sheets") arriving continuously one sheet at a time into stacks or bundles. More specifically, the invention relates to a novel stacker drum for affording even more positive and accurate sheet accumulation operation in an apparatus of this type.

Among apparatuses such as automatic counters for sheets such as paper money, there are those wherein counted sheets are sent out and arrive continuously one sheet at a time at a certain point. In an apparatus of this character, an automatic sheet accumulating device is installed downstream of the point where the counted sheets are sent out and is operated to perform processing such as aligning and stacking the sheets into the form of neat stacks or bundles each of a specific number of sheets and binding each bundle.

If, during this operation, a defective action or malfunctioning of any of the parts of the device should occur to cause a disturbance of the continuous operation thereby to give rise to folding of sheets or upward flipping of sheets, the previous step of counting will come to naught, and the sheets will tend to be damaged.

SUMMARY OF THE INVENTION

It is an object of this invention to provide, in a sheet accumulating device of the above stated character, a novel and improved stacker drum constituting an essential part of the device, by which provision, sheet accumulation can be carried out with high degree of positiveness and accuracy with minimum probability of malfunctioning as mentioned above.

According to this invention, briefly summarized, there is provided in a sheet accumulating device having a stacker drum adapted to rotate about a horizontal axis and having at least one cylindrical drum structure provided around the cylindrical surface thereof with a plurality of blades secured at their inner root parts to the drum structure and extending tangentially in the direction opposite to the circumferential direction of rotation of the drum structure to their outer ends, each blade thereby having an outer leading surface and an opposite, inner trailing surface, sheets such as pieces of paper money fed continuously and successively along a feeding chute being fed into respective spaces between adjacent blades of the rotating stacker drum to be successively upended and accumulated into neat stack, the improvement which comprises a leaf spring secured at an outer end thereof to the outer end of each of said blades on the outer leading surface thereof and extending toward the root part of the adjacent blade in said rotational direction, said leaf spring having a convex curved surface facing and lightly contacting the inner trailing surface of said adjacent blade, said leaf spring being adapted to reduce the degree of freedom of a sheet fed into the space between the said convex curved surface and said adjacent blade.

The nature, principle, and utility of this invention will be apparent from the following detailed description with respect to a preferred embodiment of the invention when read in conjunction with the accompanying drawings briefly described below, throughout which like parts are designated by like reference numerals and characters.

DETAILED DESCRIPTION OF THE INVENTION

Figure 1:
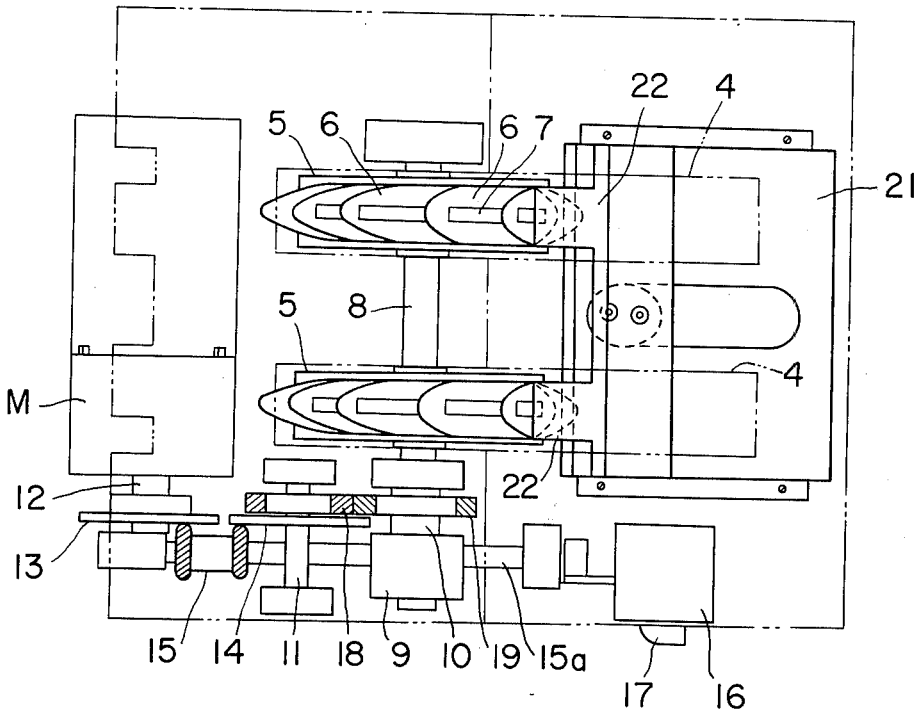
FIG. 1 is a plan view showing a sheet accumulating device in which is provided one example of a stacker drum according to this invention.
Figure 2:
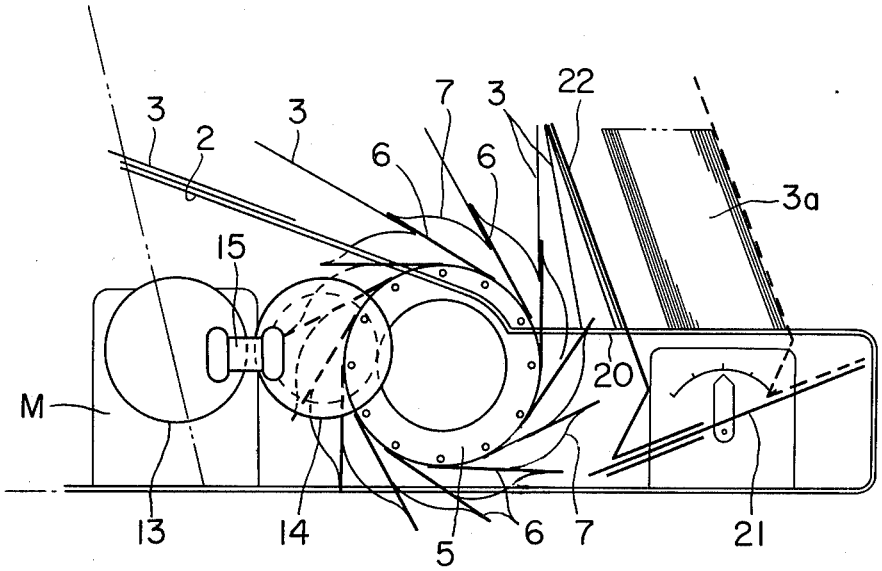
FIG. 2 is a side elevation of the device illustrated in FIG. 1.
Figure 3:
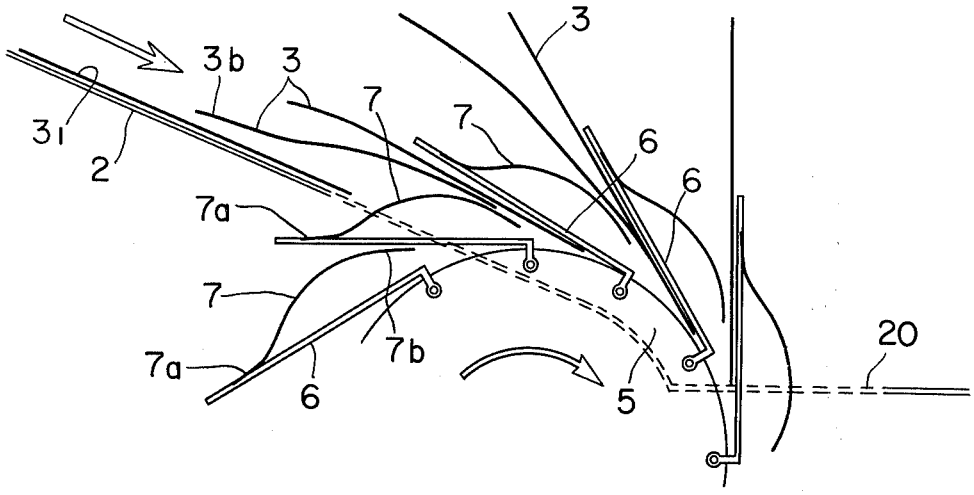
FIG. 3 is an enlarged side elevation for a description of the stacking action of the stacker drum of this invention.

The stacker drum according to this invention constitutes an essential part of a sheet acccumulating device which is illustrated by one example in FIGS. 1, 2, and 3, and which is installed in a sheet counter, for example. The accumulating device is provided with a feeding chute 2 declined forwardly and downwardly from an outlet (not shown) through which sheets 3 are sent out and then slide down the feeding chute 2. The lower end of the feeding chute 2 is contiguously adjoined by an accumulation platform 20. The feeding chute 2 and the platform 20 are provided with two spaced-apart windows 4,4 which are of elongated shape extending parallelly in the direction of travel of the sheets 3.

Two drum structures 5,5 of a stacker drum are mounted in mutually spaced-apart relation on a horizontal stacker drum shaft 8 rotatably supported to lie transversely relative to the direction of travel of the sheets 3. The stacker drum is thus supported at a position mostly below the chute 2 such that the upper parts of its drum structures 5,5 project upward through respective windows 4,4 and beyond and above the chute 2.

This stacker drum 5,5 is adapted to rotate in the direction such that its upper part rotates in the direction of travel of the sheets 3, i.e., in the clockwise direction as viewed in FIG. 2. Each of the drum structures 5,5 of the stacker drum is provided at equal intervals around its outer cylindrical surface with a plurality of blades 6,6 . . . extending from their proximal root parts tangentially relative to the cylindrical surface in the direction opposite to that of rotation of the stack drum. Each blade 6 thereby has an outer front or leading surface and an opposite, inner back or trailing surface.

In accordance with this invention, curved leaf springs 7,7, . . . are provided on respective blades 6,6, . . . , each spring 7 being secured at its outer end to the outer tip part of its respective blade 6 on the outer leading surface thereof and extending in the rotational direction of the stacker drum to lightly contact the inner back or trailing face of the adjacent blade 7 in the rotational direction. Each leaf spring 7 is curved to have a convex surface facing the back face of the adjacent blade 6.

The stacker drum 5 is variably driven by a mechanism of the following description. The two drum structures of the stacker drum 5 are fixedly mounted on the aforementioned stacker drum shaft 8, which is coupled by way of an electromagnetic clutch 9 to a tubular shaft 10 coaxial with the stacker drum shaft 8. A counter shaft 11 and the rotor shaft 12 of a motor M are provided parallelly to the tubular shaft 10. A driving disk 13 and a driven disk 14 lying in the same vertical plane are fixedly mounted on the motor shaft 12 and the counter shaft 11, respectively.

These two disks 13 and 14 are intercoupled by a rubber spool roller 15 which is in contact at its ends with these disks, and which is adapted to move transitional along its axis. The spool roller 15 is thus moved in its axial direction by a speed regulator 16 operated by a control lever 17 and acting through a connecting rod 15*a*, on which the spool roller 15 is rotatably mounted. The counter shaft 11 and the tubular shaft 10 are intercoupled by rubber disks 18 and 19 fixedly mounted respectively thereon and contacting each other to transmit rotational power by friction therebetween.

As mentioned hereinbefore, the downwardly sloped feeding chute 2 is contiguously adjoined on the downstream side of the stacking drum 5,5 by an accumulation platform 20, which is horizontal. The aforementioned windows 4,4 extend into this platform 20. Below the accumulation platform 20, there is provided an inclined plate 21 inclined upwardly in the direction of travel of the sheets 3. A receiving plate 22 is slidably supported on the inclined plate 21 and extends upwardly in a direction substantially perpendicular to the inclined plate 21.

When the stacker drum 5,5 is rotated by power transmitted from the motor M through the above described power transmission mechanism, and the sheets 3 successively slide down the feeding chute 2, the leading edge of each sheet 3 reaching the stacking drum 5,5 slips into the space between two adjacent blades 6,6 which happens to be in position for receiving this sheet and is thereby clamped between the leaf spring 7 of the succeeding blade 6 and the reverse face of the preceding blade 6. The sheet 3 thus caught is then raised upward as the stacker drum 5,5 rotates further.

Then, as the stacker drum 5,5 rotates further through approximately 90° of angle, and the root parts of the blades 6,6 on the two sides of the instant sheet 3 sink below the accumulation platform 20 through the windows 4,4, the leading edge, which is now at the lower part of the sheet, strikes against the accumulation platform 20 and is left behind by the blades. The instant sheet 3 is then caused to stand upright by the receiving plate 22 standing erect just in front.

In some instances, two sheets are thus lifted up at one time. In the same manner as described above, the sheets 3 are successively fed and sent toward the receiving plate 22 thereby to accumulate in the form of a stack or bundle 3*a*. The receiving plate 22 is caused by the growing bundle 3*a* to slide backward along the inclined plate 21 but exerts a light backwardly pressing force due to gravity on the bundle 3*a*.

Figure 4:
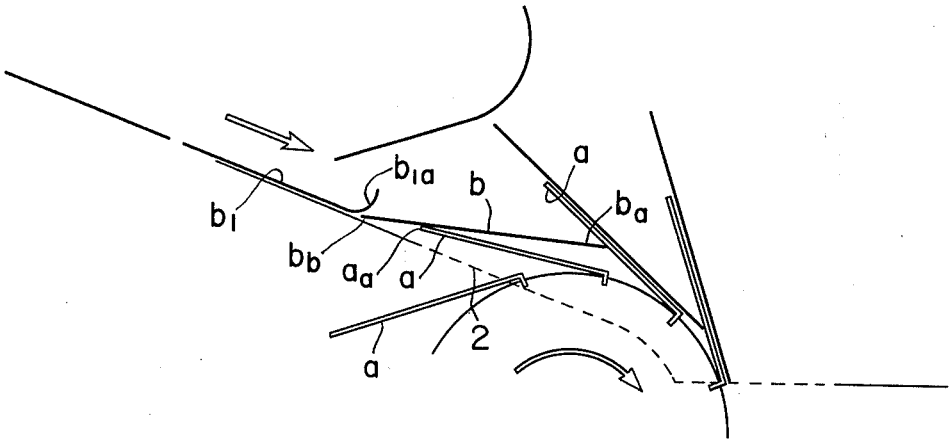
FIG. 4 PRIOR ART
FIG. 4 is a view similar to FIG. 3 showing a stacker drum known in the prior art.

The difference between the stacker drum according to this invention and a known stacker drum will now be described with reference to FIGS. 3 and 4. In the known stacker drum as shown in FIG. 4, leaf springs are not provided between the blades *a, a*, . . . , and the spacing between adjacent blades *a, a* is relatively large. Consequently, the degree of freedom of the leading edge of each entering sheet *b* is great.

For this reason, when a blade *a* rises to raise a sheet *b*, there are instances wherein the sheet *b* rotates in the manner of a lever about the outer end $a_a$ of the blade *a* as a fulcrum, and the leading edge $b_a$ of this sheet *b* is thereby wafted upward to strike the reverse face of the preceding blade, the trailing edge $b_b$ of the sheet *b* remaining in contact with the surface of the feeding chute 2. The succeeding sheet $b_1$ bumps into this trailing edge $b_b$, whereby the smooth sheet flow is disturbed. This gives rise to bending and folding of the sheets due to jostling in some cases and in other cases to overriding of the succeeding sheet $b_1$ past the trailing edge $b_b$ and into the space above the preceding sheet *b*, but, since the blade *a* rises before the succeeding sheet *b* can infiltrate fully into that space, the leading edge $b_{1a}$ of the succeeding sheet $b_1$ is lifted upwardly, and this sheet $b_1$ is flipped upward by the dynamic energy of the sheet flow.

On one hand, the preceding sheet *b* may be bent and folded against the outer end $a_a$ of the blade *a* by the weight of the succeeding sheet $b_1$ which has overridden onto the preceding sheet *b*, in which case, the movement of the stacker drum and the feeding flow of the sheets will become mutually interfering and disorderly, and the sheet accumulation operation cannot be carried out satisfactorily. This disturbance occurs frequently because the rotation of the stacker drum and the flow of the sheets are not necessarily synchronized.

In contrast, the leaf springs 7 provided on respective blades 6,6 lightly contact the rear surface of their respectively preceding blades and cause the spaces therebetween to converge and become narrow toward the proximal root ends of the blades. For this reason, each sheet is firmly held and has almost no degree of freedom when it enters into the above mentioned space. Then, as the corresponding blade 6 swings upward, the trailing edge $3_b$ of the sheet 3 is also lifted, and the succeeding sheet $3_1$ passes under the trailing edge $3_b$ of the preceding sheet 3 and slides smoothly into the space between the blades 6 without obstruction. Thus, there is no disorder of sheet flow as described above.

As will be apparent from the above description, a feature of this invention is that positive and orderly accumulation of sheets is afforded by a simple construction in which leaf springs are merely installed on respective blades of the stacker drum. Another feature of this invention is that stacker drums according to this invention can be adapted to be used in an existing sheet accumulation device thereby to increase the positiveness of the stacking operation and the reliability of the entire sheet accumulation device.

We claim:

1. In a sheet accumulating device having a stacker drum adapted to rotate about a horizontal axis and having at least one cylindrical drum structure provided around the cylindrical surface thereof with a plurality of blades secured at their inner root parts to the drum structure and extending tangentially in the direction opposite to the circumferential direction of rotation of the drum structure to their outer ends, each blade thereby having an outer leading surface and an opposite, inner trailing surface, sheets such as pieces of paper money fed continuously and successively along a feeding chute being fed into respective spaces between adjacent blades of the rotating stacker drum to be successively upended and accumulated into neat stack, the improvement which comprises a leaf spring secured at an outer end thereof to the outer end of each of said blades on the outer leading surface thereof and extending toward the root part of the adjacent blade in said rotational direction, said leaf spring having a convex curved surface facing, and lightly contacting the inner trailing surface of said adjacent blade, said leaf spring being adapted to reduce the degree of freedom of a sheet fed into the space between the said convex curved surface and said adjacent blade.

2. A sheet accumulating device as set forth in claim 1 in which said stacker drum has a plurality of drum structures adapted to rotate unitarily and each having said plurality of blades each provided with said leaf spring.

* * * * *